US005596783A

United States Patent [19]

Testone

[11] Patent Number: 5,596,783

[45] Date of Patent: Jan. 28, 1997

[54] SHEET AND WEB CLEANER WITH FACE PLATE ON SUCTION HOOD

[75] Inventor: Anthony Q. Testone, Schwenksville, Pa.

[73] Assignee: Electrostatics, Inc., Harleysville, Pa.

[21] Appl. No.: 486,235

[22] Filed: Jun. 7, 1995

[51] Int. Cl.[6] ..... A47L 13/40

[52] U.S. Cl. ..... 15/1.51; 15/309.1; 361/213

[58] Field of Search ..... 15/1.51, 306.1, 15/308, 309, 309.1, 345; 361/213, 214, 222

[56] References Cited

U.S. PATENT DOCUMENTS

| | | | |
|---|---|---|---|
| 1,715,199 | 5/1929 | Johnston | 15/308 |
| 2,818,595 | 1/1958 | Rosewall | 15/309.1 |
| 3,841,910 | 10/1974 | Baker | 15/306.1 |
| 4,454,621 | 6/1984 | Testone . | |
| 4,934,016 | 6/1990 | Kalin | 15/309.1 |

FOREIGN PATENT DOCUMENTS

| | | | |
|---|---|---|---|
| 1148668 | 5/1963 | Germany | 361/222 |
| 54-152890 | 12/1979 | Japan | 361/214 |
| 1444138 | 7/1976 | United Kingdom | 15/309.1 |

*Primary Examiner*—David Scherbel
*Assistant Examiner*—Terrence R. Till
*Attorney, Agent, or Firm*—Irvin A. Lavine; Nath & Associates

[57] ABSTRACT

A sheet and web cleaner comprises a pair of substantially identical units in facing relation, providing a path for transporting a sheet or web between them. Each unit includes a suction hood with a rectangular inlet slot, and a pair of channels adjacent and parallel to the slot, each containing a pressurized air ionizing bar which discharges ionized air at high velocity onto the moving sheet or web. A plate of hard smooth plastic is over the channels and the inlet slot and has in one side a central elongate inlet opening of tapering width which extends partly through the thickness of the plate and overlies the rectangular inlet slot. Elongate air discharge openings extending partly through the thickness of the plate and overlying each of the channels are adjacent the inlet opening. On the opposite side of the plate, which is proximate the sheet or web, there are a plurality of spaced ridges of generally triangular cross-section, with their apices proximate the sheet or web, the spaces between the ridges extending partially through the thickness of the plate to communicate with the openings in the opposite side of the plate. The ridges are inclined to the direction of movement of the sheet or web.

18 Claims, 3 Drawing Sheets.

FIG. 4
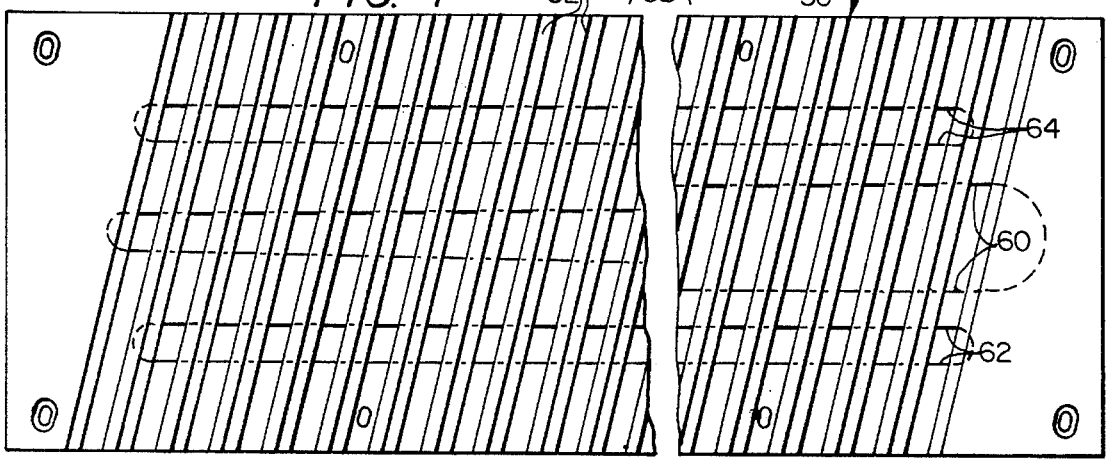
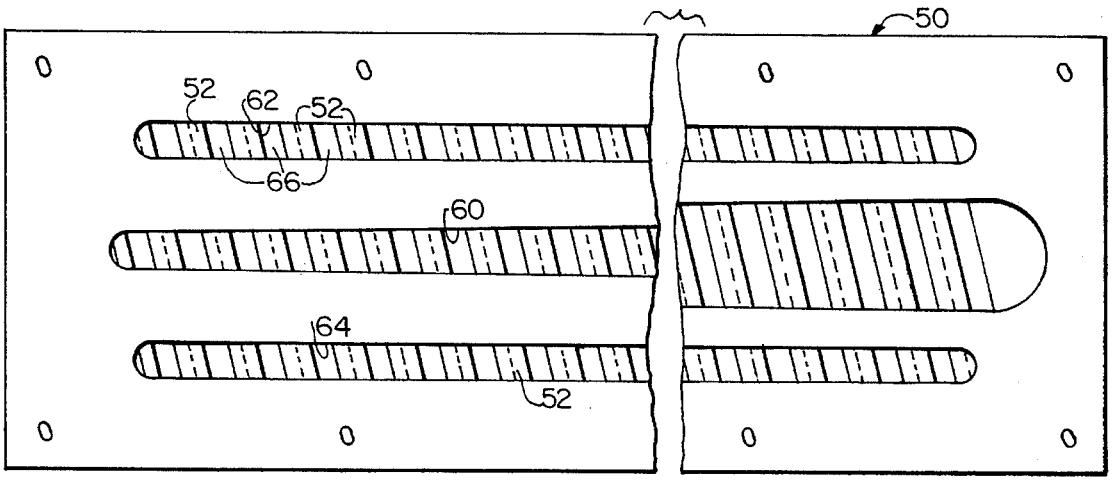
FIG. 5
FIG. 6
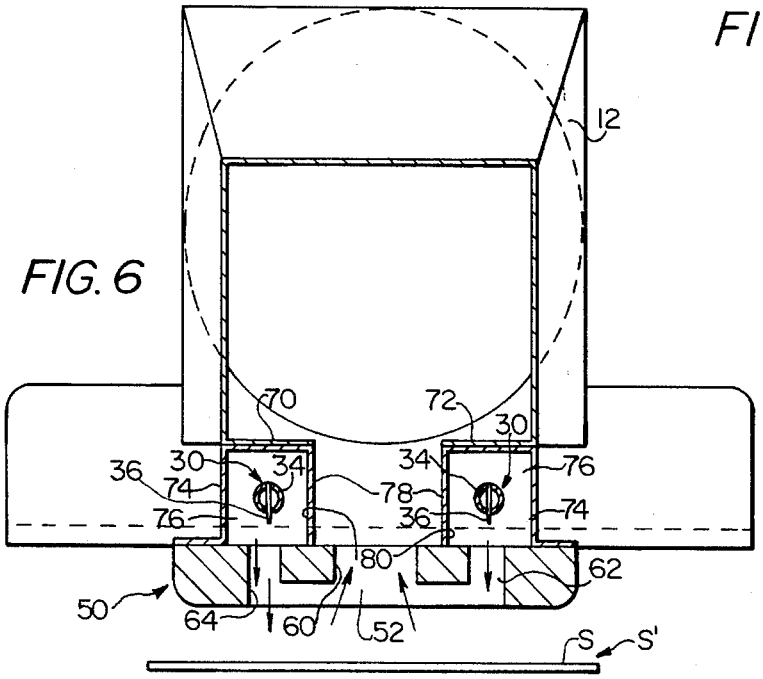

SHEET AND WEB CLEANER WITH FACE PLATE ON SUCTION HOOD

BACKGROUND OF THE INVENTION

The present invention relates to apparatus for cleaning electrostatically adhered particles from moving sheets and webs.

In many industries, sheets and webs of indeterminate length are fed to various processing apparatus, said such as printing, gluing, winding, etc. It is important in many instances that these sheets and webs be cleaned, and it has therefore been proposed to blow air on them to remove dust and other particles.

A known sheet and web cleaning apparatus is disclosed in Testone U.S. Pat. No. 4,454,621, having a pair of spaced, opposed suction hoods, between which there is transported a sheet or web to be cleaned. The suction hoods are made of formed sheet metal, and are of increasing cross-sectional area from a first end, towards a second end to which a suction hose or the like is connected. The suction hood is provided with an inlet slot which is of tapering width, being wider remote from the second end where the suction hose is connected. Adjacent the surface of the suction hood containing the inlet slot, there is a housing which contains a pair of pressurized ionizing bars in spaced, parallel relationship, providing between them a suction slot which enables air to be drawn through it and into the suction hood. A throat plate is attached to each housing, and the sheet or web passes between the throat plates. In this construction, air flowing through the inlet slot of the suction hood is comprised of air discharged by the pressurized ionizing bars, and by additional air drawn from atmosphere and passing between the throat plate and the moving sheet or web. The speed of the sheet or web was substantially less than 3,000 feet per minute.

The above described prior art apparatus was found to have a number of deficiencies. In order to remove as many particles as possible, a relatively high flow of air including ions, was required to be drawn into the suction hood. However, in some instances, the low pressure created by this flow of air was found to cause some sheets or webs to adhere to one or the other of the throat plates, thus substantially inhibiting air flow into the suction hood. The result was that a portion of the sheet or web was not cleaned, and in some instances the sheet or web was drawn into the suction slot. This required that the entire sheet or web feeding and handling apparatus be stopped, and the blowers of the sheet and web cleaner cut off, so that the attraction of the sheet or web to the sheet and web cleaner could be broken. This was time consuming, required labor to remedy the situation, and caused interruption of production.

Another problem with the above noted sheet and web cleaner is that the metal throat plates became scratched through use. The throat plates were the parts of the sheet and web cleaner closest to the sheet or web being fed. As some of these sheets or webs were prone to scratching and since such scratching was unacceptable, there occurred this further deficiency in the noted prior art apparatus. In particular, if the sheet or web was coated paper or plastic film such those of acetate and Mylar, they were readily harmed by scratches.

Further, the sheet and web cleaner did not clean the sheet and web to the extent desired, because it has been found that in some instances it dislodged a particle from the sheet or web, which was not removed by suction, but adhered to the apparatus, and then became attached to the sheet or web, after the sheet or web had been subjected to the cleaning action.

The above described sheet and web cleaner was also expensive to manufacture. It required substantial effort to form a number of sheet metal parts, and to assemble the many parts including suction hoods, ionizing bars, housings for the ionizing bars, and throat plates.

SUMMARY OF THE INVENTION

A sheet and web cleaner is provided comprising a pair of substantially identical facing units, each having a longitudinal suction hood having a generally rectangular inlet slot therein. On either side of and parallel to the inlet slot is a channel containing a pressurized ionizing bar which comprises a hollow tube, a plurality of ionizing points extending from the tube, and small holes adjacent each ionizing point to discharge air at high velocity. The sheet or web passes through a pair of opposed units as above described, transversely of the longitudinally extending suction hoods, and between face plates on the units.

Each face plate is of smooth hard plastic material, such as high density polypropylene, and has in the side adjacent the sheet or web a series of spaced, parallel ridges which extend part way through the thickness of the face plate. The ridges are inclined to the direction of movement of a sheet or web through the apparatus, and are also inclined to the axis of the suction hood, and to the axes of the ionizing bars. The ridges of the face plate are of generally triangular cross-section, each having an apex relatively close to the sheet and web, and remote from the suction hood, the spaces between the ridges providing a plurality of converging air paths which are in communication with elongate openings in the opposite surface of the face plate, which also extend partly through the face plate thickness. There is a central, elongate inlet opening which is of tapering width, with the greater width remote from the suction end of the suction hood in order to permit the flow of equal quantities of air into the suction hood through the rectangular inlet slot of the suction hood. There is also provided an elongate side discharge opening in the face plate on either side of the central tapered inlet opening, each of which is in registry with an ionizing bar to permit ionized air discharged from the ionizing bar to flow through the discharge openings in the face plate and through the spaces between the ridges. The high velocity ionized air strikes the moving sheet or web, neutralizing the electrostatic attraction of particles to the sheet or web, the flow induced by suction carrying them into the suction hood.

Among the objects of the present invention are to provide a sheet and web cleaner for electrostatically removing particles from a sheet or web being transported therethrough which will permit continuous, uninterrupted movement of the sheet or web.

Another object of the present invention is to provide a sheet and web cleaner which avoids adherence of a sheet or web to the apparatus with resultant loss of productivity.

Yet another object of the present invention is to provide a sheet and web cleaner which will avoid imparting scratches to the sheet or web being cleaned.

Still another object of the present invention is to provide a sheet and web cleaner having superior cleaning ability to thereby provide sheets and webs which are of greater cleanliness and which are substantially free of particles adhered to them, and to do so with sheets or webs moving a speeds of approximately 3,000 feet per minute.

Still another object of the present invention is to provide a sheet and web cleaner of improved, less expensive construction.

Other objects and many of the attendant advantages of the present invention will be readily understood from consideration of the specification, claims and drawings.

BRIEF DESCRIPTION OF THE DRAWINGS

FIG. 4 is a plan view of one side of a face plate forming a part of the present invention, with parts broken away.

FIG. 5 is a plan view of the other side of the face plate shown in FIG. 4.

FIG. 6 is a cross-sectional view taken on the line 6—6 of FIG. 1.

DESCRIPTION OF THE PREFERRED EMBODIMENT

Figure 1:
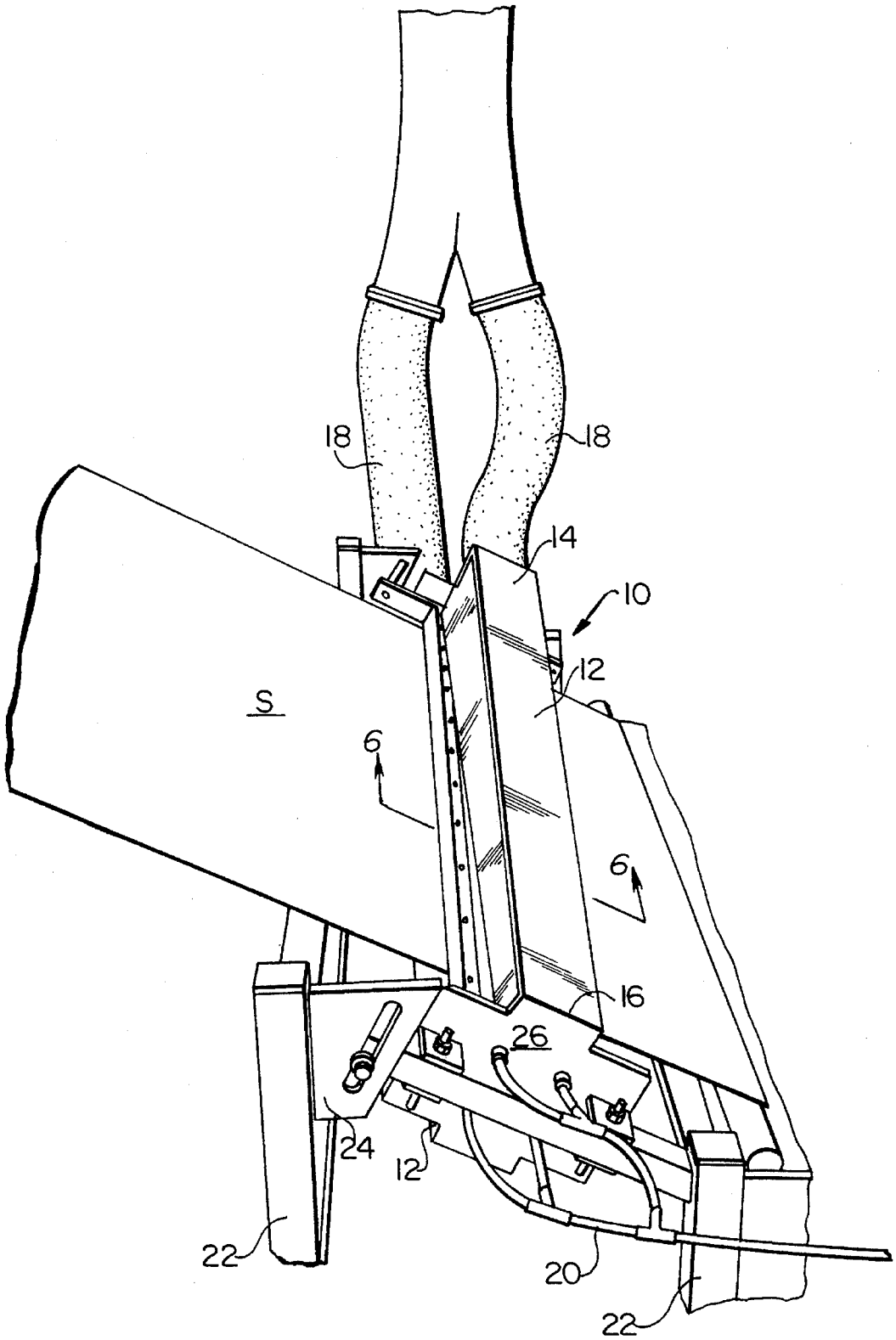
FIG. 1 is a perspective view of a sheet and web cleaner in accordance with the present invention.

Referring now to the drawings, wherein like or corresponding reference numerals are used for like or corresponding parts throughout the several views, there is shown in FIG. 1 a sheet and web cleaner 10 in accordance with the present invention, through which a sheet S is passing and is being cleaned. The sheet S may be a relatively fragile, easily scratched material such as coated paper and plastic film such as acetate and Mylar. Typically, it may have a speed through the sheet and web cleaner 10 of approximately 3,000 feet per minute. The sheet and web cleaner 10 comprises a pair of substantially identical units, one located on side or above the sheet S, and the other located on the other side or below the sheet S. The units forming the sheet and web cleaner 10 are substantially identical, and each includes an elongate suction hood 12 having a large end 14, and being of decreasing cross-section to the opposite, closed end 16. At the end 14, a duct 18 is connected to each of the suction hoods 12, these ducts 18 being connected to a fan or other suction device (not shown). A pressurized air conduit 20, with four branches, provides pressurized air to ionizing bars as described below.

The sheet and web cleaner 10 is supported on legs 22 and a support frame 24, to which is attached through mounting plate 26.

Figure 2:
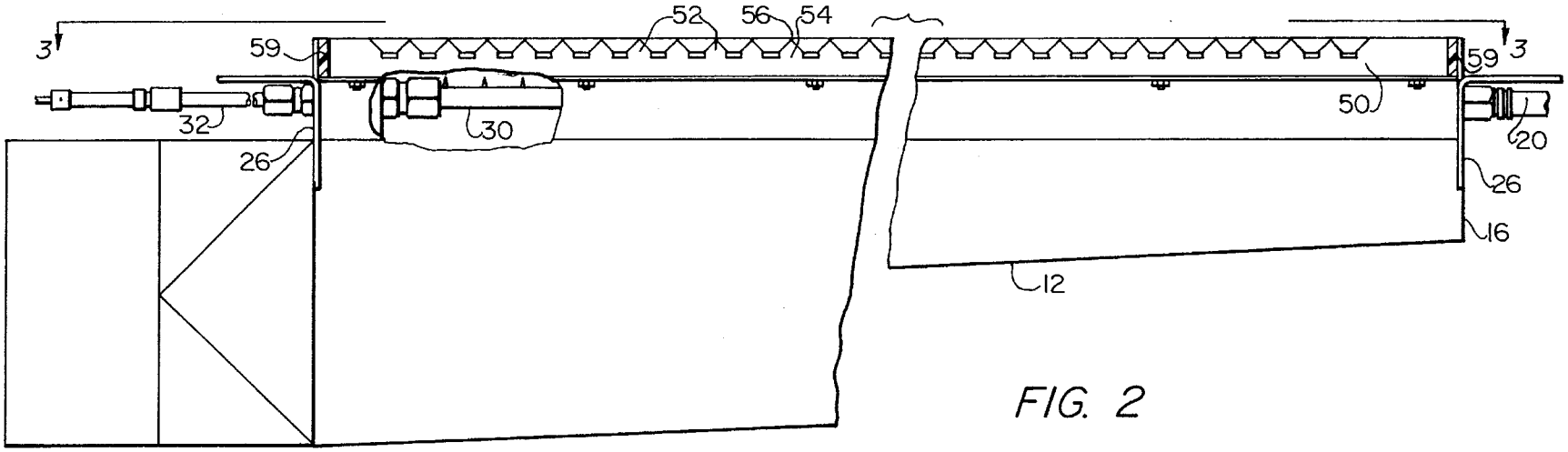
FIG. 2 is an elevational view with parts removed and broken away of a suction hood and face plate forming a unit of the present invention sheet and web cleaner.

In FIG. 2, there will be seen the hood 12 which is of somewhat pyramidal shape, having above it an ionizing bar 30 which is linearly extending from end to end of the suction hood. At one end, there is connected to ionizing bar 30 an air conduit 20 which supplies air at relatively high pressure, of approximately 10–12 psi. Adjacent the end of ionizing bar 30 which is remote from the air conduit 20 is a conductor 32 for supplying alternating current to ionizing bar 30 from a suitable source.

In the preferred embodiment herein disclosed, a face plate 50 extends over the ionizing bars 30, and comprises a series of spaced ridges 52 each of which, as shown, has a triangular portion 54 with an apex 56 to provide a series of contact elements to be engaged by a sheet S passing through the sheet and web cleaner 10. The ridges 52 extend part way through the thickness of face plate 50, and between ridges 52 are spaces 58. The face plate 50 is machined from a plate which has opposite sides and is of relatively smooth, hard plastic material, such as high density polypropylene.

Figure 3:
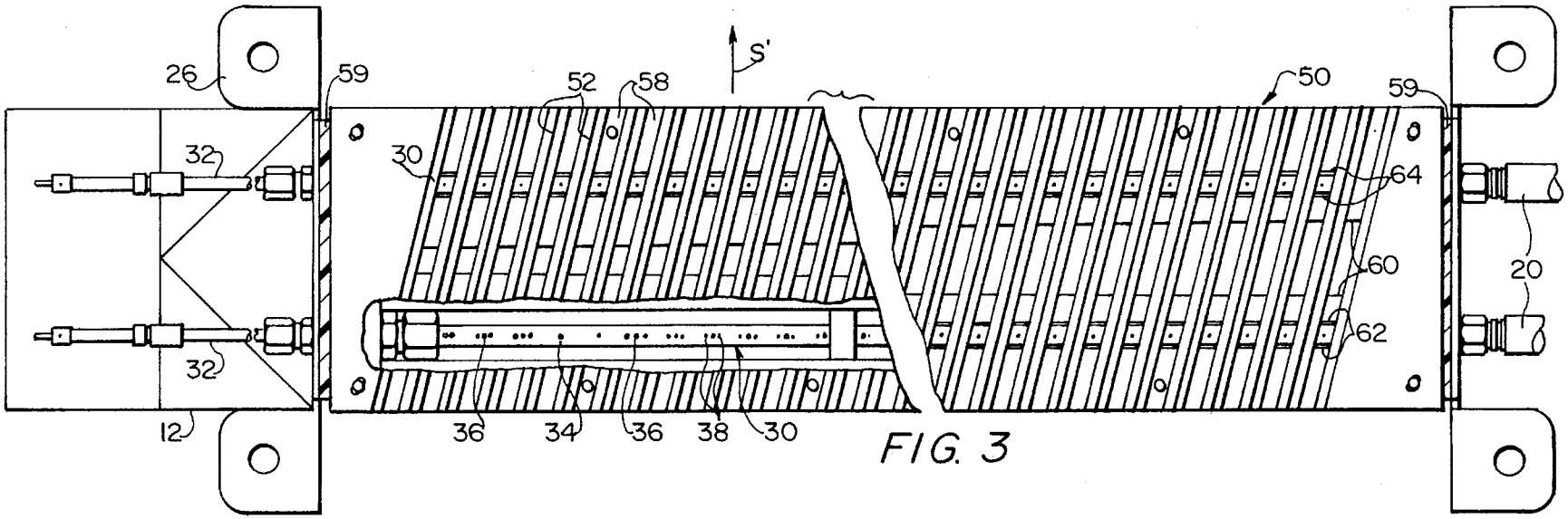
FIG. 3 is a view taken on line 3—3 of FIG. 2, with parts removed and broken away.

In FIG. 3 there is shown a pair of spaced ionizing bars 30, which are in parallel relation, and which are substantially identical. Thus, each has an air conduit 20 at one end and a conductor 32 at the other end. Each ionizing bar 30 comprises a hollow, preferably cylindrical, tube 34 having a series of transverse linearly spaced ionizing points 36 extending from them, as shown in FIG. 6. On either side of each of the ionizing points 36 is an opening 38 for the discharge of pressurized air substantially parallel to each ionizing point 36. These openings 38 are approximately 1/64 inch in diameter. There is thereby discharged from each of the ionizing bars 30 a very high velocity, low volume stream of air, which contains ions as created by the application of alternating current from the conductor 32 to the ionizing points 36.

The spaced parallel ridges 52 of the face plate 50 are inclined at an oblique angle to the axis of the ionizing bars 30 and to the direction of movement of the sheet S, indicated by the arrow S'. At the ends of the face plate 50, there are provided foam strips 59, to close the gap between the face plate 50 and the mounting plate 26. On the opposite side of face plate 50, as is discussed below, there are elongate openings in the face plate 50, including a tapered central elongate opening 60 and a pair of side elongate openings 62 and 64, the openings 62 and 64 being in registry with the ionizing bars 30. The openings 60, 62 and 64 extend part way through the thickness of face plate 50.

In FIG. 4, there is shown the same side of face plate 50 as in FIG. 3, including the spaced parallel ridges 52, and the central tapered elongate inlet opening 60 which is wider at the right hand end and tapers to a narrow width at the left hand end thereof as shown in FIG. 4. There may also be seen the elongate side openings 62 and 64. The spaces 58 (see FIG. 3) between the ridges 52 provide openings which are in communication with the openings 60, 62 and 64 to permit air to flow from the ionizing bars 30 through the face plate 50 to strike sheet S; the central tapered elongate opening 60 permits air to flow through the spaces 58 of face plate 50 and into the suction hood 12. The area of the central tapered elongate inlet opening 60 is substantially equal to the combined areas of the elongate side openings 62 and 64.

Referring now to FIG. 5, there is shown the opposite side of face plate 50 to that in FIG. 4, where there may be seen the elongate side openings 62 and 64, and between them the central tapered elongate opening 60. Extending in inclined configuration across the openings 60, 62 and 64 are the ridges 52, with spaces 58 between them.

In FIG. 6, there is shown the suction hood 12 which, in cross-section, is of generally square shape, and being of modified pyramidal configuration in the longitudinal direction. A wall 70 of suction hood 12 has a rectangular longitudinally extending inlet slot 72, and on either side of the inlet slot 72 there is mounted a pair of spaced parallel channels 74, each of the channels 74 comprising a pair of parallel walls 76 and 78. The walls 76 and 78 of each channel 74 provide an elongate rectangular air discharge opening 80 between them, and between the proximal walls 78 of the channels 74 there is a continuation of the inlet slot 72.

The face plate 50 which is shown taken on line 6—6 of FIG. 5 for clarity, underlies and is in engagement with the channels 74, with the elongate side openings 62 and 64 in registry with the openings 80 in each of the channels 74. The tapered elongate central opening 60 is in registry with the elongate rectangular opening between the walls 78 of channels 74 and the rectangular inlet slot 72 of suction hood 12.

In operation, the web or sheet S is caused to pass through the sheet and web cleaner 10, and more specifically, between, parallel to and transversely of the two spaced, parallel face plates 50 and transversely of said elongate side openings 62 and 64. The sheet S moves at high speed, which may be approximately 3,000 feet per minute. The width of the face plate, in a practical embodiment of the present sheet and web cleaner 10, is approximately one-half foot in the direction of movement of the sheet S, represented by the arrow S' on FIGS. 3 and 6. Hence, the time of exposure of each portion of the sheet S is approximately 0.017 second. As the sheet S moves through the sheet and web cleaner 10, the ionizing bars 30 will generate ions, which are carried at high velocity therefrom, exiting from the openings of holes 38 in the tube 34 at very high velocity and low volume, carrying the ions generated by the ionizing points 36 through the opening 80 in each of the channels 74 and thence through openings 62, 64 in face plate 50 and into the spaces 58 between the ridges 52. The ionized air at high velocity then strikes a face of the rapidly moving sheet S, and is drawn through the space 66 between ribs 52, the central tapered elongated central opening 60, the opening between the walls 78 of the channels 74, and the inlet slot 72 of suction hood 12. The air velocity at inlet slot 72 is 1,500 feet per minute or more. The high velocity ionized air from ionizing bars 30 strikes every portion of the surface of sheet S, from the two units of the sheet and web cleaner 10, dislodging all particles, dirt, etc. which are on and/or electrostatically attracted to the sheet S by neutralizing the electrostatic attraction of such particles and/or dirt, so that they are carried in the air streams from each of the units, as shown by the arrows in FIG. 6, into the suction hood 12.

Due to the shape of each suction hood 12, and the tapered elongate opening 60, a substantially uniform volume and velocity of ionized air, carrying removed particles and/or dust enters the suction hoods 12 along the length thereof. As above noted, electrostatic cleaning is accomplished in the extremely small time of approximately 0.017 second during which each portion of the sheet S is subjected to the action of the sheet and web cleaner 10.

The face plate 50, being of smooth hard plastic material having substantially the density of high density polypropylene, does not become scratched or rough and therefore does not scratch the sheet S, should the sheet S come into contact with it, and due to the inclined orientation of the ridges 50, every portion of the sheet S is subjected to the ionized air discharged from the ionizing bars 30: no portion of the surface of sheet S is prevented from being engaged by ionized air from each ionizing bar 30 as it rapidly passes through the sheet and web cleaner 10. Moreover, even should the sheet S engage one or the other of the face plates 50, there occurs no blockage of air flow into the inlet slot 72 of the suction hood 12 due to the space 66 between the inclined ridges 52.

The sheet and web cleaner 10 of the present invention is readily manufactured having minimal parts. In addition, the sheet and web cleaner 10 as herein disclosed will permit high volume of production, with minimal shutdown of equipment, since the construction avoids the suction of the sheet into the apparatus. The smooth high density plastic face plate 50 permits moving contact with the sheet S without scratching sheet S, and this advantage is obtained even though air flow through or into the suction hood 12 is in the order of 1,500 feet per minute or more. The face plate 50 is readily produced by using computer controlled machining apparatus, resulting in highly accurate and inexpensive manufacture of the face plate.

In addition, with the herein disclosed construction, the triangular shape of the portions of the ridges 52 which are in facing relationship to the sheet S substantially reduces the risk that dirt which has been removed from the sheet S by the ionized air discharged from the ionizing bars 30 will lodge on the apparatus, and then be subsequently re-attached to the moving sheet. Hence, there is avoided an insufficiently cleaned sheet due to reattachment of particles to the moving sheet so that improved cleaning is achieved.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. Apparatus for cleaning from a moving web particles which are adhered to it by static electricity comprising:

an elongate suction hood having a substantially rectangular inlet slot having two ends, said suction hood having an end for connection to a source of suction and being of reducing transverse cross-section from said end to the opposite end thereof, a pair of linearly extending pressurized air ionizing bars, one on either side of said inlet slot for discharging away from said suction hood high velocity air containing ions, a plate having opposite sides over said substantially rectangular inlet slot, said plate having in the side thereof proximate said inlet slot a central tapered elongate inlet opening overlying said inlet slot, said inlet opening in said plate being of tapering width with the greater width thereof at the end of said inlet slot proximate said opposite end of said suction hood, and openings in said plate extending from the opposite side of said plate to and in communication with said central elongate tapered inlet opening.

2. The apparatus as claimed in claim 1, said plate having a pair of elongate side openings therein each overlying a said elongate pressurized air ionizing bar, said openings in said plate extending from the opposite side of said plate being in communication with said pair of elongate side openings.

3. The apparatus as claimed in claim 2, said suction hood comprising a pair of spaced substantially parallel channels, each channel comprising two spaced, parallel walls, proximal walls of said channels providing an opening in registry with said inlet slot, each said channel having a discharge opening adjacent said opening between said proximal walls of said channels.

4. The apparatus as claimed in claim 3, wherein said discharge opening of each said channel is substantially rectangular.

5. The apparatus as claimed in claim 3, wherein a said air ionizing bar is in each said channel.

6. The apparatus as claimed in claim 2, said plate having a series of spaced, parallel ridges extending on the opposite side thereof, the spaces between said ridges providing said openings in communication with said inlet opening and said pair of elongate side openings.

7. The apparatus as claimed in claim 6, a web to be cleaned having a direction of movement transverse of said elongate side openings when passing said plate, said ridges being obliquely inclined relative to said inlet opening and said elongate side openings, and to the direction of movement of a web passing said plate.

8. The apparatus as claimed in claim 7, wherein said ridges are of generally triangular cross-section, with apices thereof remote from said suction hood.

9. The apparatus as claimed in claim 2, the area of said central tapered elongate inlet opening being substantially the same as the combined areas of said elongate side openings in said plate.

10. The apparatus of claim 1, said plate being hard and smooth and having substantially the density of high density polypropylene.

11. Apparatus for cleaning form a moving web particles adhered to it by static electricity comprising:

a suction hood having a longitudinally extending inlet slot, a plate having first and second spaced sides, said first side of said plate being adjacent said suction hood, an inlet opening in said first side and extending partially through said plate, said inlet opening overlying said inlet slot in said hood, said plate having on said second side a plurality of spaced ridges with spaces between said ridges extending partially through said plate and communicating with said inlet opening, said ridges being parallel and inclined at an oblique angle to said longitudinally extending inlet slot.

12. The apparatus according to claim 11, said ridges being of triangular cross-section and having apices remote from said suction hood.

13. The apparatus according to claim 11, said suction hood being elongate and of linearly increasing cross-section and comprising a smallest and a largest cross-section, said inlet slot being rectangular and said inlet opening being of tapering width, with the widest portion adjacent the smallest cross-section of said suction hood.

14. The apparatus according to claim 11, said plate being hard and smooth and having substantially the density of high density polypropylene.

15. The apparatus according to claim 11, and at least one pressurized air ionizing bar for directing high velocity ionized air away from said suction hood.

16. The apparatus according to claim 15, said plate having at least one discharge opening therein extending to the first side thereof and in communication with said air ionizing bar, and at least one space in said opposite side of said plate in communication with said discharge opening to provide a passage for ionized air from said air ionizing bar to said opposite side of said plate.

17. The apparatus according to claim 16, said at least one air ionizing bar being adjacent said inlet slot in said suction hood, said discharge opening in said plate being adjacent said inlet opening.

18. The apparatus according to claim 17, and further comprising a channel adjacent said inlet slot, said air ionizing bar being in said channel.

* * * * *